United States Patent [19]

Hug

[11] 4,128,133

[45] Dec. 5, 1978

[54] TORQUER/THRUSTER FOR FLEXIBLE ROOFDRILL

[75] Inventor: Hans A. Hug, Weston, Mass.

[73] Assignee: The United States of America as represented by the Secretary of the Interior, Washington, D.C.

[21] Appl. No.: 684,018

[22] Filed: May 7, 1976

[51] Int. Cl.[2] ..... B23Q 5/033

[52] U.S. Cl. ..... 173/149; 173/152; 226/162; 226/124; 74/88

[58] Field of Search ..... 173/36, 19, 148, 149; 226/150, 162; 279/4

[56] References Cited

U.S. PATENT DOCUMENTS

| | | | |
|---|---|---|---|
| 2,638,324 | 5/1953 | Ball et al. | 173/149 |
| 2,730,331 | 1/1956 | Harinck | 173/149 |
| 3,133,469 | 5/1964 | Wungberg | 226/150 |
| 3,246,706 | 4/1966 | Feucht et al. | 173/36 |
| 3,690,687 | 9/1972 | Moe | 279/4 |
| 3,819,073 | 6/1974 | Asselborn et al. | 226/162 |
| 3,854,645 | 12/1974 | Knights | 226/162 |

*Primary Examiner*—Robert A. Hafer

*Attorney, Agent, or Firm*—Gersten Sadowsky; Donald A. Gardiner

[57] ABSTRACT

A torquer/thruster with a hydrostatically actuated chuck assembly configured to drivingly engage a flexible roofdrill for applying rotational torque and longitudinal thrust to the roofdrill shaft. The chuck assembly is mounted within a rotatable and longitudinally movable piston assembly, the chuck and piston assemblies fixed against relative movement with respect to one another. The piston assembly is mounted within a rotating barrel assembly, the piston and barrel assemblies being fixed against relative rotational movement and being constrained for limited longitudinal movement with respect to one another.

10 Claims, 6 Drawing Figures

TORQUER/THRUSTER FOR FLEXIBLE ROOFDRILL

BACKGROUND OF THE INVENTION

1. Field of Invention

The present invention relates to devices for rotating drill shafts and, more particularly, is directed towards a device for applying torque and thrust to flexible roofdrill shafts.

2. Description of the Prior Art

In the mining industry, falls of mine roofs account for a large percentage of the fatalities that occur in coal mines. Thus, roof control has been a major safety and production consideration. Roof fall fatalities have been greatly reduced in cases where the mine roof is supported with roof bolts that are inserted into holes which are drilled into the mine roof using a drill that is attached to a rigid shaft. As the holes become progressively deeper, the mine worker adds extension sections to the drill shaft. Such an operation requires the worker to be at the head of a roof drilling machine for starting the hole, for adding the extension sections and for inserting the bolts. Flexible roofdrills have been designed for the drilling of roof bolt holes, the flexible roofdrill shaft being significantly greater than the mining height. A need has arisen for a device for applying torque and thrust to such flexible roofdrills.

SUMMARY OF THE INVENTION

It is an object of the present invention to provide a torquer/thruster for applying rotational torque and longitudinal thrust to flexible roofdrill shafts. The torquer/thruster is characterized by a hydrostatically actuated chuck assembly having a cylindrical collet with a plurality of longitudinally extending slits intermediate its ends, the roofdrill shaft received within the collet. An elastomeric bladder is fitted snugly over the collet. A hydraulic fluid urges the bladder against the collet, portions of the collet between adjacent slits drivingly engaging the roofdrill shaft. The collet and bladder are mounted within a hydraulically actuated cylindrical piston that is splined to a rotating barrel. The collet, bladder and piston are fixed against relative movement with respect to one another. The piston and barrel are fixed against relative rotational movement and are constrained for limited longitudinal movement with resepct to one another. A hydraulically driven wheel assembly, which rotates with the barrel, engages the flexible shaft for preventing unwanted longitudinal movement of the shaft. The rotating barrel constitutes a rotating union through which the hydraulic fluid for the bladder, piston and drive wheel assembly flows. A flip-flop valve which is actuated by longitudinal movement of the piston controls the flow of hydraulic fluid for selective longitudinal movement of the piston. The chuck engages the flexible roofdrill shaft when the piston is moved in the direction for roofdrill advancement and disengages the flexible roofdrill when the piston is moved in the opposite direction. The drive wheel assembly prevents movement of the flexible roofdrill in the direction opposite advancement when disengaged by the chuck.

Other objects of the present invention will in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
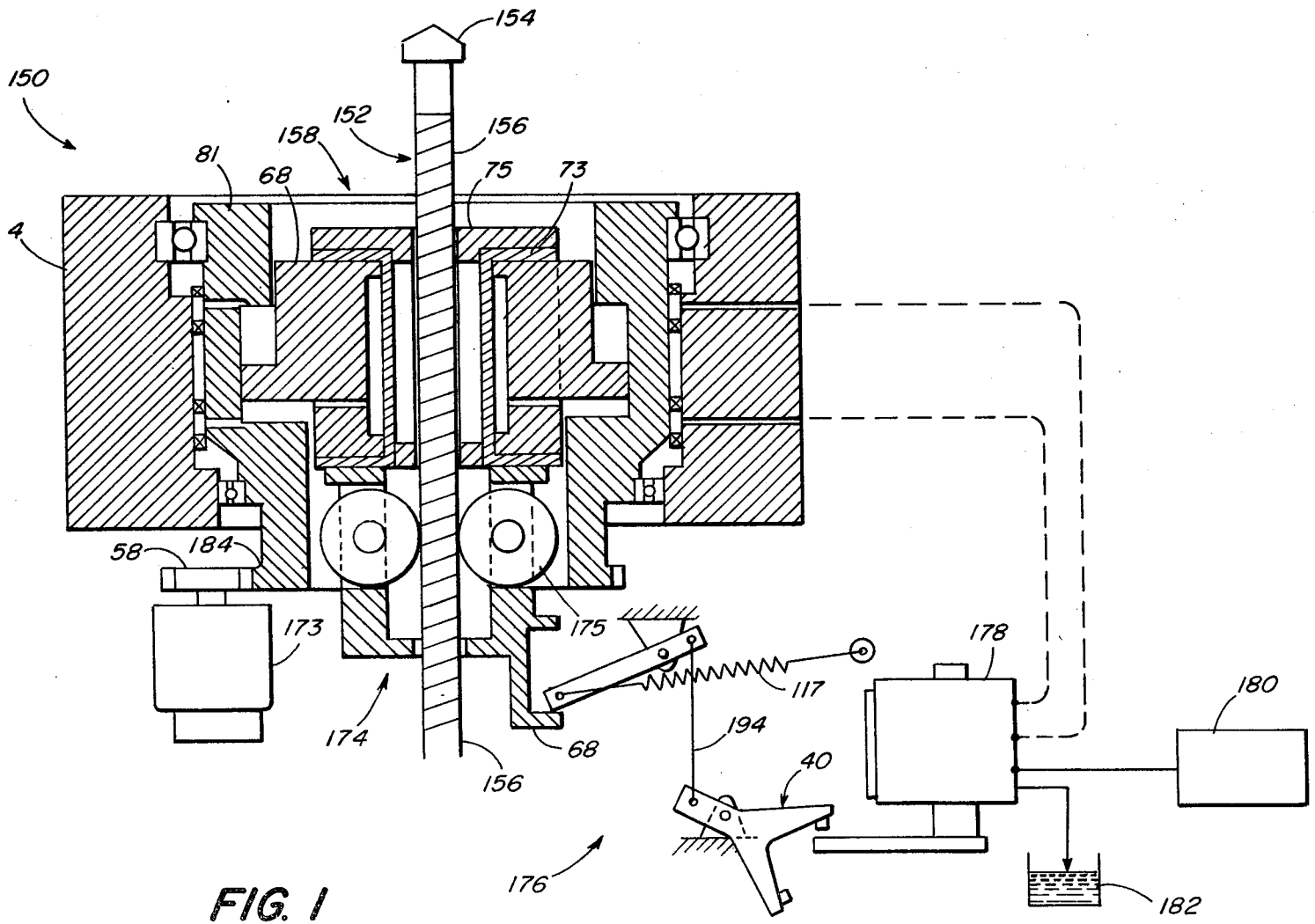
FIG. 1 is a schematic diagram of a torquer/thruster embodying the invention.
Figure 2:
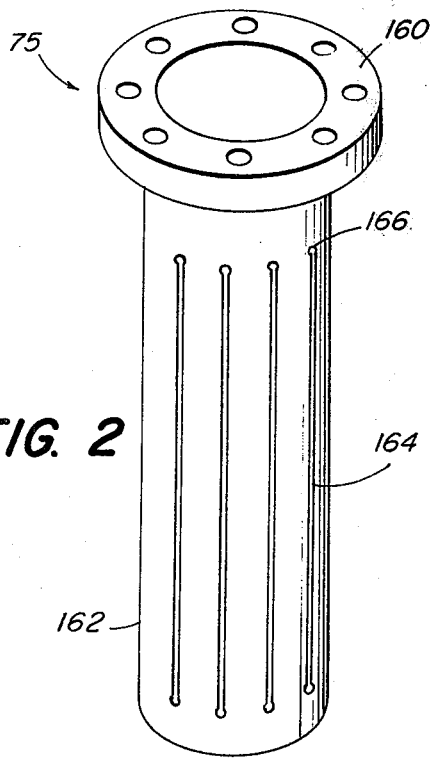
FIG. 2 is a perspective view of the collet of FIG. 1.
Figure 3:
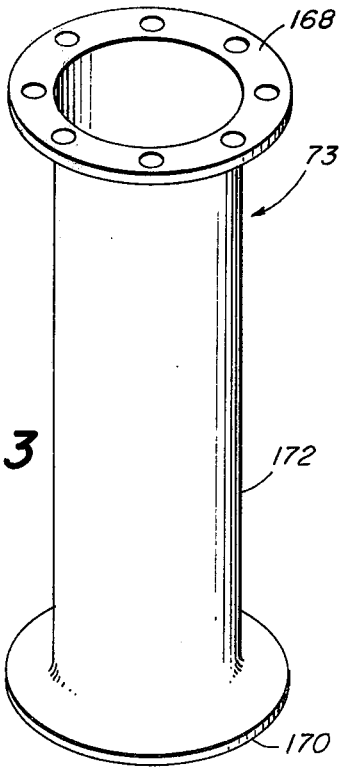
FIG. 3 is a perspective view of the bladder of FIG. 1.

Referring now to the drawings, particularly FIG. 1, there is shown a torquer/thruster 150 for applying rotational torque and longitudinal thrust to a flexible drill 152, such as a flexible roofdrill having a cutting head 154 at one end of a flexible shaft 156. A hydraulically actuated chuck assembly 158, which is configured to receive flexible shaft 156, includes an inner cylindrical collet 75 and an elastomeric bladder 73 that is fitted snugly about the collet. As shown in FIG. 2, collet 75, composed of a steel alloy for example, includes an upper flange 160 at one end of a hollow cylindrical body 162 which is formed with a plurality of longitudinally extending slits 164, each of which terminates in a circular opening 166. As shown in FIG. 3, bladder 73 includes an upper flange 168 and a lower flange 170 that are disposed at opposite ends of a hollow cylindrical body 172. Collet 75 and bladder 73 are mounted within a hydraulically actuated piston 68 that is splined to a rotating cylindrical barrel 81 that is disposed within a housing 4, barrel 81 being rotated by a hydraulic motor 173. Collet 75, bladder 73 and piston 68 are fixed against relative movement with respect to one another. That is, collet 75, bladder 73 and piston 68 move rotationally and longitudinally as an integral unit. Piston 68 and barrel 81 are fixed against relative rotational movement and are constrained for limited longitudinal movement with respect to one another. That is, piston 68 rotates with barrel 81 and moves in a longitudinal direction relative to the barrel which is not movable in the longidutinal direction, the piston and barrel being connected by a spline connection.

A hydraulically driven wheel assembly 174, which rotates with barrel 81, engages flexible shaft 156 for preventing unwanted longitudinal movement of the shaft. Rotating barrel 81 constitutes a rotating union through which the hydraulic fluid for bladder 73, piston 68 and drive wheel assembly 174 flows. A flip-flop valve 176, which is actuated by longitudinal movement of the piston controls the flow of hydraulic fluid through a shuttle valve 178 for selective longitudinal movement of piston 68. Shuttle valve 178 is connected to a suitable hydraulic pump 180 and a sump 182. Collet 75 engages the flexible roofdrill shaft when piston 68 is moved in the direction for roofdrill advancement and disengages the flexible roofdrill when the piston is moved in the opposite direction. Drive wheel assembly 174 prevents movement of the flexible roofdrill in the direction opposite advancement when disengaged by collet 75.

Figure 4:
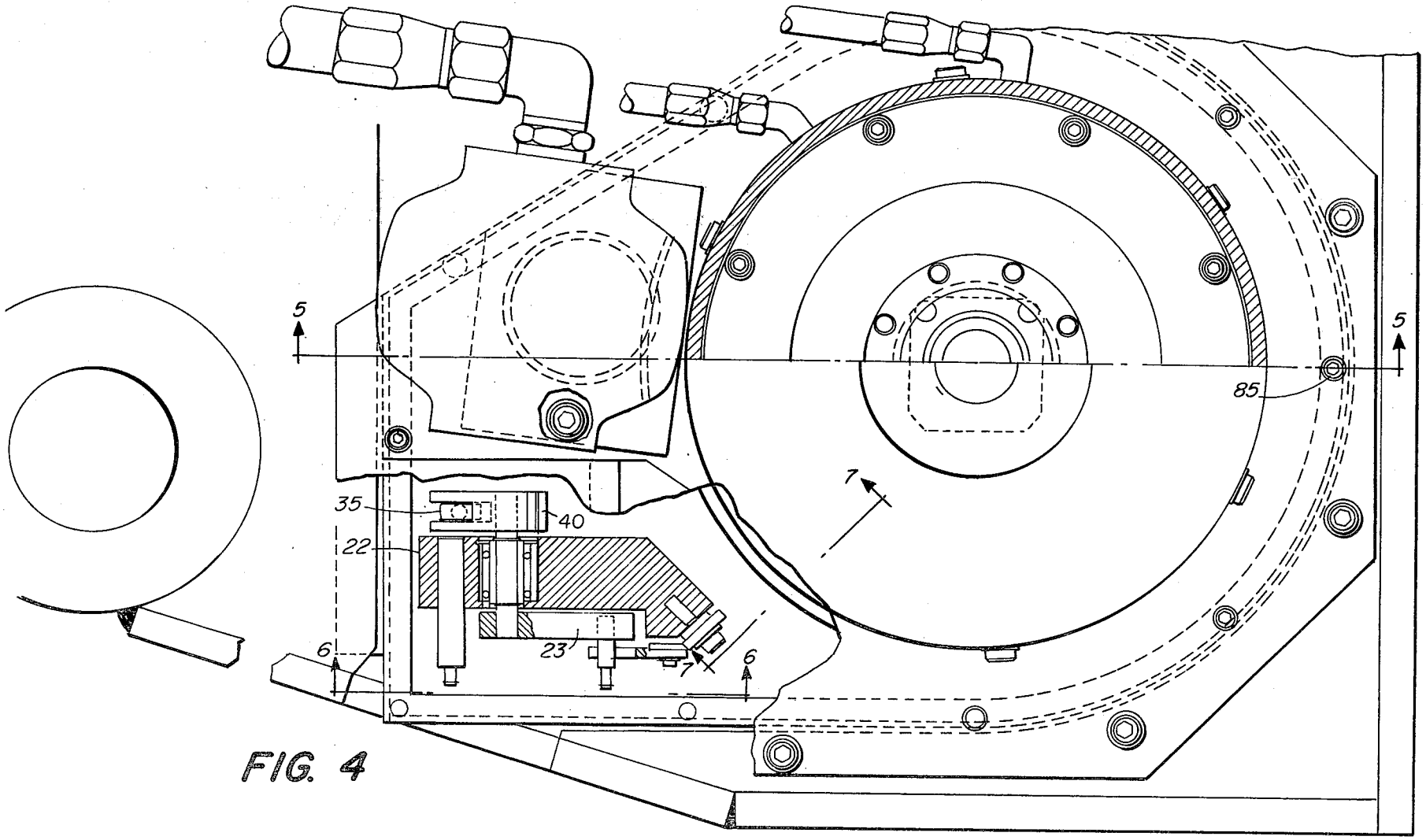
FIG. 4 is a top plan view of the torquer/thruster of FIG. 1.
Figure 5:
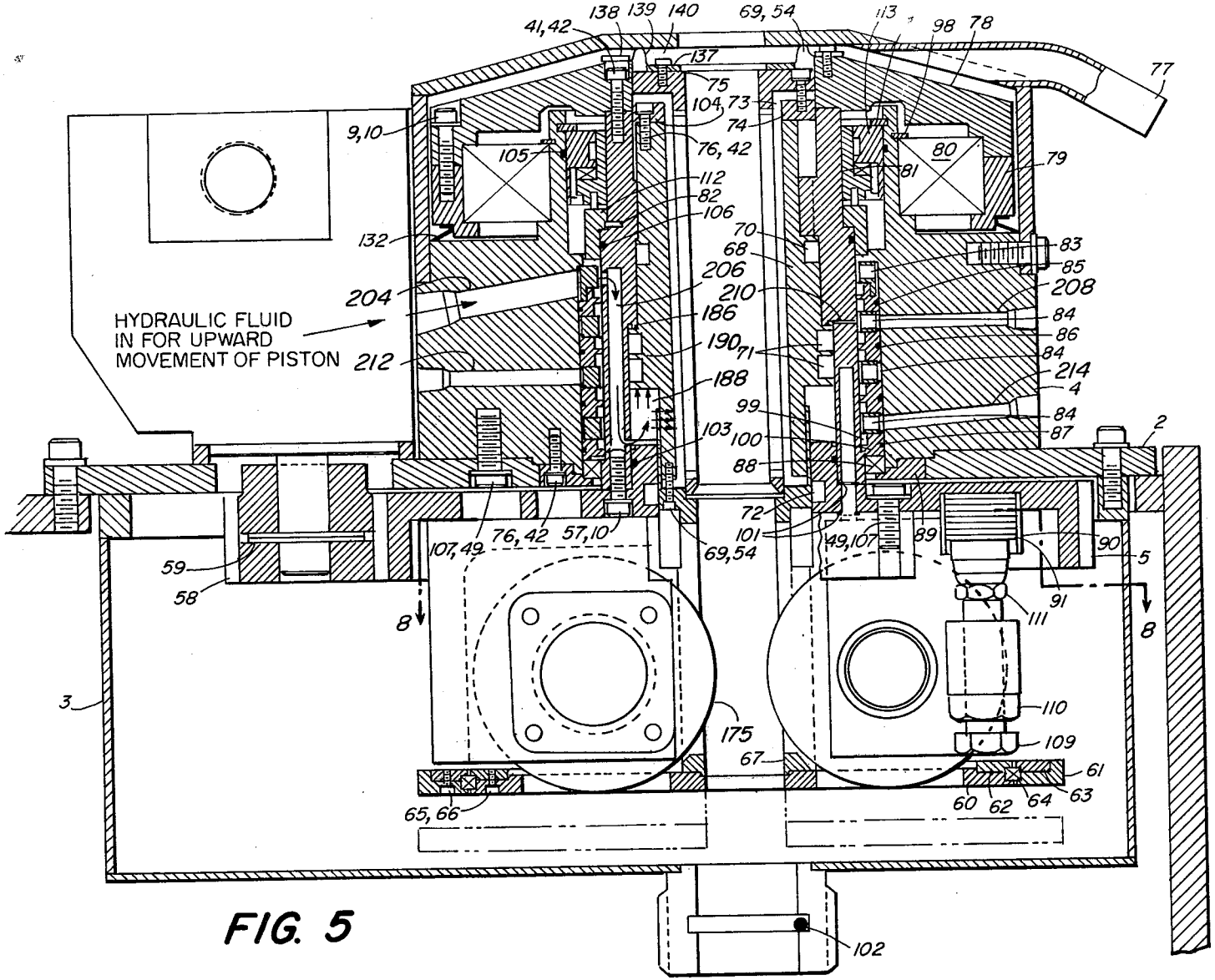
FIG. 5 is a sectional view taken along the lines 5—5 of FIG. 4.

Referring now to FIGS. 4 and 5, it will be seen that torquer/thruster 150 is provided with a top cover 77 that is mounted to housing 4. At the upper end of housing 4, there is provided an upper bearing 80, upper bearing retainer 79, upper bearing mounting disc 78, and rings 97, 98. A seal assembly 113 is disposed between housing 4 and barrel 81. Also disposed between housing 4 and barrel 81 are oil rings 83, 84 and seal rings 85, 86, and 87, the seal rings being provided with O-rings 100. Mounted below seal ring 87 is a lower bearing 88 with associated bearing retainer 89 that is pressed against a mounting plate 2.

A diaphram seal 139, which is captively held by a pair of rings 137 and 138 constitutes a dust boot between housing 4 and collet 75. An adapter ring 74 is located between the upper end of piston 68 and the flange of bladder 73, an O-ring 104 provided at the upper face of piston 68. Piston seals 70 and 71 are mounted at the interface of piston 68 and barrel 81. A plurality of seals 99 are at the interface of seal rings 86 and 87 in contact with the outermost face of barrel 81. A mating ring 112, which is held by a dowel pin 82 is provided above oil ring 83. A V-ring seal 132 is located at the lower edge of upper bearing retainer 79 in housing 4.

As previously indicated, barrel 81 is rotated by hydraulic motor 173. A drive pinion 58, which is connected to a shaft of hydraulic motor 173 with a spring pin 59 engages a bull gear 184 that is drivingly connected to barrel 81. A lower cover 3 is placed about drive wheel assembly 174. In the preferred embodiment, drive wheel assembly 174 includes four drive wheels 175 which bear against flexible shaft 156, the drive wheels being equally spaced from one another. In the preferred embodiment, one of the drive wheels is a driven wheel and the other of the wheels are idle wheels.

Figure 6:
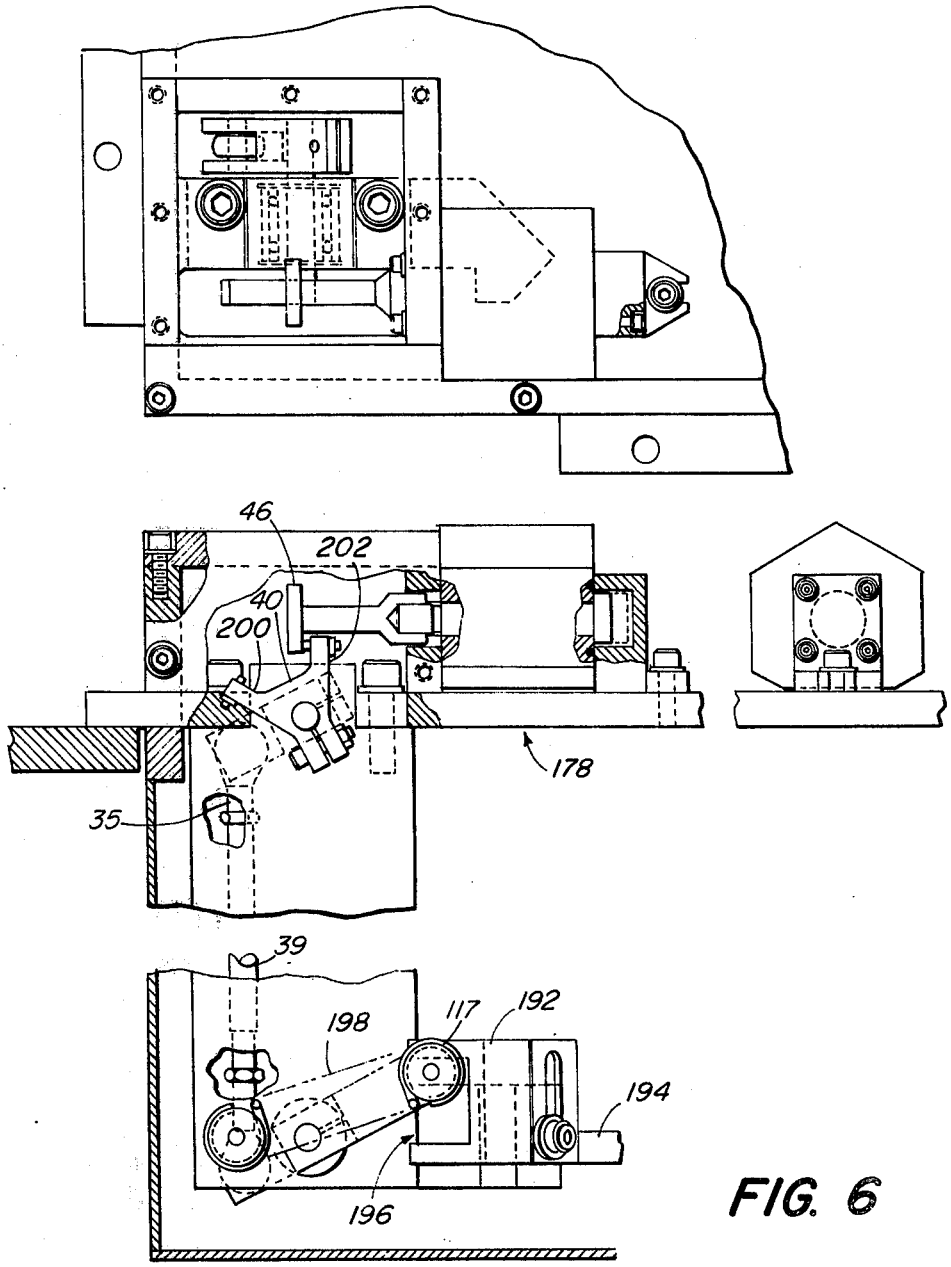
FIG. 6 is a sectional view taken along the lines 6—6 of FIG. 4.

As previously indicated with reference to FIG. 1, flip-flop valve 176 is actuated by the longitudinal movement of piston 68 for controlling flow of hydraulic fluid into an upper chamber 186 and a lower chamber 188 disposed on opposite faces of an annular flange portion 190 of piston 68. The lower end of piston 68 is connected, as shown in FIG. 6, to a yoke 192 by a rod 194, the yoke having a substantially U-shaped channel 196. One end of a lever arm 198 is disposed within U-shaped channel 196, and as more particularly appears in FIGS. 1 and 6, the other end of lever arm 198 being connected to a rod 39 which is further connected at rod end 35 to a shifting fork 40. A hook spring 117 is connected to the end of lever arm 198 disposed within channel 196, the other end of the lever arm being connected to a mounting block 22 shown in FIG. 4. Shifting fork 40 is pivotally connected to rod 39. Shifting fork 40 has a pair of extending arms 200 and 202 that are configured to alternately engage an extension 46 of shuttle valve 178. When piston 68 moves downwardly, yoke 192 moves downwardly and carries with it the end of lever arm 198 within channel 196. When yoke 192 has traveled approximately one half its total longitudinal movement, hook spring 117 drives lever arm 198 downwardly, whereby rod 39 moves upwardly and arm 200 shifting fork 40 engages extension 46 of shuttle valve 78 for reversing the direction of piston 68 movement. In another words, flip-flop valve 176 is responsive to longitudinal movement of piston 68, the flip-flop valve having first and second states. Flip-flop valve 176 is in its first state as shown in FIG. 6, for example, when piston 68 is approaching its uppermost limit. When flip-flop 176 is in the position shown in FIG. 6, shuttle valve tends to drive piston 68 downwardly. As piston 68 moves downwardly, flip-flop valve 174 changes to its second state as piston 68 approaches its lower limit. In consequence, arm 200 of shifting fork 40 engages extension 46 of shuttle valve 178 and piston 68 is driven upwardly.

When hydraulic fluid enters chamber 188 through conduits 204, 206, as more fully appears in FIG. 5, piston 68 is urged upwardly and bladder 73 is pressed against collet 75 which drivingly engages flexible shaft 156. When piston 68 approaches its upper limit, hydraulic fluid enters chamber 186 through channels 208 and 210 for urging piston 68 downwardly. The hydraulic fluid chamber 188 exits through channels 206 and 204. Consequently, collet 75 disengages flexible shaft 156. Drive wheel assembly 174 prevents the flexible drill shaft from moving downwardly until the driving operation is completed. The torque on drive wheel assembly 174 is sufficiently high to prevent downward movement of flexible shaft 156 and is sufficiently low to prevent slippage between the drive wheels and flexible shaft. Hydraulic fluid for maintaining the necessary torque on drive wheel assembly 174 is applied through a channel 212. When flexible drill 152 is to be removed, hydraulic fluid enters a channel 214 and the drive wheel is driven in an opposite direction for removal of the flexible drill.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A device for applying rotational torque and longidutinal thrust to a flexible drill, said device comprising:

(a) a housing;

(b) a cylindrical barrel rotatably mounted within said housing;

(c) cylindrical piston means mounted within said barrel, said piston fixed against rotational movement with respect to said barrel, said piston constrained for limited longitudinal movement with respect to said barrel;

(d) collet means mounted within said piston, said collet means configured to engage and to disengage a flexible drill shaft;

(e) bladder means disposed between said piston means and said collet means, said piston means, said bladder means and said collet means fixed against movement with respect to one another;

(f) means for urging said bladder means against said collet and for longitudinally moving said piston means, said collet means engaging the flexible drill shaft when said bladder means is urged against said collet means; and (g) friction means mounted for rotational movement with said barrel, said friction means engaging the flexible drill shaft for selectively controlling longitudinal movement of the flexible drill shaft.

2. The device as claimed in claim 1 wherein said collet means is a hollow cylindrical member formed with a plurality of longitudinally extending slits intermediate its ends.

3. The device as claimed in claim 2 wherein said bladder means is a hollow cylindrical member composed of an elastomer, said bladder means having said cylindrical collet means fitted snugly within said hollow thereof.

4. The device as claimed in claim 3 wherein said urging means includes hydraulic means communicating with said piston means and said bladder means, said hydraulic means forcing said bladder means against the surface of said cylindrical collet, portions of said cylindrical collet between adjacent ones of said slits drivingly engaging the flexible drill shaft when said bladder is forced against said cylindrical collet.

5. The device as claimed in claim 4 wherein said hydraulic means includes flip-flop valve means responsive to longitudinal movement of said piston means, said flip-flop valve means having first and second states, said flip-flop valve means in said first state as said piston means is moving in a first direction for advancing the flexible drill, said flip-flop valve means changing from its first state to its second state as said piston means approaches its limit in said first direction, said piston means moving in a second direction which is opposite said first direction when said flip-flop valve means is in its second state, said flip-flop valve means changing from its second state to its first state as said piston means approaches its limit in said second direction.

6. A device for applying rotational torque and longitudinal thrust to a flexible drill, said device comprising:

(a) a housing;

(b) a cylindrical barrel rotatably mounted within said housing;

(c) cylindrical piston means mounted within said barrel, said piston constrained for limited longitudinal movement with respect to said barrel, said piston rotating with said barrel;

(d) collet means mounted within said piston, said collet means configured to engage and to disengage a flexible drill shaft;

(e) bladder means disposed between said piston means and said collet means, said piston means, said bladder means and said collet means fixed against movement with respect to one another and rotating with said piston means;

(f) means for urging said bladder means against said collet and for longitudinally moving said piston means, said collet means engaging the flexible drill shaft when said bladder means is urged against said collet means, said piston means, said bladder means and said collet means longitudinally and rotationally moving together; and (g) drive wheel means mounted for rotational movement with said barrel, said drive wheel means engaging the flexible drill shaft for selectively controlling longitudinal movement of the flexible drill shaft.

7. The device as claimed in claim 6 wherein said collet means is a hollow cylindrical member formed with a plurality of longitudinally extending slits intermediate its ends and wherein said bladder means is a hollow cylindrical member composed of an elastomer, said bladder means having said cylindrical collet means fitted snugly within said hollow thereof.

8. The device as claimed in claim 7 wherein said piston means is formed with an annular flange, upper and lower chambers formed on opposite side faces of said flange, said lower chamber communicating with an exterior surface of said bladder means, a hydraulic fluid alternately entering and exiting said upper and lower chambers, said hydraulic fluid introduced into said lower chamber moving said piston means upwardly and forcing said bladder means against said collet means, said hydraulic fluid introduced into said upper chamber moving said piston means downwardly, said hydraulic fluid exiting said upper chamber when entering said lower chamber and exiting said lower chamber when entering said upper chamber, said bladder means forced against said collet means only when said hydraulic fluid enters said lower chamber.

9. The device as claimed in claim 7 wherein said urging means includes hydraulic means communicating with said piston means and said bladder means, said hydraulic means longitudinally moving said piston means in a first direction and in a second direction, said first direction opposite said second direction, said hydraulic means forcing said bladder means against the surface of said cylindrical collet means when said piston means is moved in said first direction, portions of said cylindrical collet between adjacent ones of said slits drivingly engaging the flexible drill shaft when said bladder is forced against said cylindrical collet.

10. The device as claimed in claim 9 wherein said hydraulic means includes flip-flop valve means responsive to longitudinal movement of said piston means, said flip-flop valve means having first and second states, said flip-flop valve means in said first state as said piston means is moving in said first direction for advancing the flexible drill, said flip-flop valve means changing from its first state to its second state as said piston means approaches its limit in said first direction, said piston means moving in said second direction when said flip-flop valve means is in its second state, said flip-flop valve means changing from its second state to its first state as said piston means approaches its limit in said second direction.

* * * * *